US007370452B2

(12) United States Patent
Rogers

(10) Patent No.: US 7,370,452 B2
(45) Date of Patent: May 13, 2008

(54) MAT ASSEMBLY FOR HEAVY EQUIPMENT TRANSIT AND SUPPORT

(76) Inventor: Melissa B. Rogers, 309 Foreman Dr., Lafayette, LA (US) 70506

( * ) Notice: Subject to any disclaimer, the term of this patent is extended or adjusted under 35 U.S.C. 154(b) by 0 days.

(21) Appl. No.: 10/245,467

(22) Filed: Sep. 16, 2002

(65) Prior Publication Data

US 2004/0049995 A1 Mar. 18, 2004

(51) Int. Cl.
*E04B 5/10* (2006.01)
*E04B 5/02* (2006.01)

(52) U.S. Cl. ..... 52/177; 52/181; 52/223.9; 52/223.11; 52/404.4; 52/650.1; 52/647

(58) Field of Classification Search ..... 52/177, 52/223.11, 223.9, 223.12, 650.3, 729.1, 647, 52/729.2, 729.3, 729.4, 181, 404.4, 588.1, 52/589.1, 636, 650.1, 578, 592.1, 586.1, 52/660; 15/215, 238, 240; 119/450; 404/49, 404/40, 41, 51, 45; 446/124, 125
See application file for complete search history.

(56) References Cited

U.S. PATENT DOCUMENTS

| | | | | | |
|---|---|---|---|---|---|
| 544,204 | A | * | 8/1895 | Andrews | 52/177 |
| 624,862 | A | * | 5/1899 | Piver | 52/578 |
| 794,304 | A | * | 7/1905 | Karnaghan et al. | 15/238 |
| 883,049 | A | * | 3/1908 | Piver | 52/578 |
| 960,740 | A | * | 6/1910 | Vaughan | 52/729.1 |
| 1,750,284 | A | * | 3/1930 | Rusatz | 160/88 |
| 2,078,117 | A | * | 4/1937 | Auryansen | 52/780 |
| 2,141,000 | A | * | 12/1938 | Hohl | 52/308 |
| 2,382,789 | A | * | 8/1945 | Guignon, Jr. | 404/36 |
| 2,512,310 | A | * | 6/1950 | Corson | 15/215 |
| 3,110,374 | A | * | 11/1963 | Valverde | 52/581 |
| 3,156,168 | A | * | 11/1964 | Nagin et al. | 404/21 |
| 3,466,821 | A | * | 9/1969 | Cooper et al. | 52/204.1 |
| 3,716,027 | A | * | 2/1973 | Vickstrom et al. | 119/450 |
| 3,866,364 | A | * | 2/1975 | Pollard | 52/36.5 |
| 3,913,291 | A | * | 10/1975 | Dulien et al. | 52/396.04 |
| 3,984,961 | A | * | 10/1976 | Chieger et al. | 52/592.1 |
| 4,048,960 | A | * | 9/1977 | Barnidge et al. | 119/529 |
| D250,847 | S | * | 1/1979 | Lemieux | D25/123 |

(Continued)

FOREIGN PATENT DOCUMENTS

| | | | | |
|---|---|---|---|---|
| JP | 284647 | * | 11/1989 | 52/729.1 |
| JP | 258446 | * | 9/1992 | 52/729.1 |

*Primary Examiner*—Richard E. Chilcot, Jr.
*Assistant Examiner*—Phi Dieu Tran A
(74) *Attorney, Agent, or Firm*—Law Office of Jesse D. Lambert L.L.C.

(57) ABSTRACT

A mat assembly particularly suited for heavy equipment transit and support, such as roadway construction and the like. The mat assembly is made up of a number of structural members preferably having a "double I-beam" cross-sectional shape. Each I-beam has spaced apart flanges with edges preferably formed in tongue and groove profiles. When butted together, the tongue and grooves of adjacent I-beams mesh. Filler blocks are disposed in the cavities between the webs of the I-beams. Tension members extending through the webs and filler blocks tie multiple I-beams together to form the mat assembly. Preferably, both the I-beams and filler blocks are formed of a plastic material, via extrusion or other molding methods. The resulting mat is capable of bearing very high loads yet is decay resistant.

2 Claims, 11 Drawing Sheets

U.S. PATENT DOCUMENTS 4,135,339 A * 1/1979 Pawlitschek ..... 52/660
4,266,381 A * 5/1981 Deller ..... 52/177
4,488,833 A * 12/1984 Perry et al. ..... 404/35
4,510,725 A * 4/1985 Wilson ..... 52/309.1
4,570,390 A * 2/1986 Wendt ..... 52/36.6
4,584,809 A * 4/1986 Stanford ..... 52/690
4,646,493 A * 3/1987 Grossman ..... 52/223.1
4,897,299 A * 1/1990 Kawachi et al. ..... 428/131
4,952,434 A * 8/1990 Rumsey et al. ..... 428/54
5,054,253 A * 10/1991 Bedics ..... 52/177
5,062,369 A * 11/1991 Cobden et al. ..... 105/396
5,065,556 A * 11/1991 DeLong et al. ..... 52/220.7
5,133,620 A * 7/1992 Scheiwiller ..... 404/37
5,233,807 A * 8/1993 Spera ..... 52/729.1
5,617,677 A * 4/1997 Hallsten ..... 52/3
5,658,120 A * 8/1997 Watanabe ..... 414/495
5,664,393 A * 9/1997 Veilleux et al. ..... 52/729.4
5,941,027 A * 8/1999 Hallsten ..... 52/64
6,050,044 A * 4/2000 McIntosh ..... 52/591.1
6,219,990 B1 * 4/2001 Snyder et al. ..... 52/729.1
6,591,567 B2 * 7/2003 Hota et al. ..... 52/578
6,648,715 B2 * 11/2003 Wiens et al. ..... 446/121
6,701,984 B2 * 3/2004 Lamontagne et al. ..... 144/347
6,735,919 B1 * 5/2004 diGirolamo et al. ..... 52/729.4
6,779,706 B2 * 8/2004 Ezumi et al. ..... 228/112.1
2002/0023941 A1 * 2/2002 Ezumi et al. ..... 228/112.1
2002/0148191 A1 * 10/2002 Hynes ..... 52/729.1

* cited by examiner

MAT ASSEMBLY FOR HEAVY EQUIPMENT TRANSIT AND SUPPORT

BACKGROUND

1. Field of Art

This invention relates to structural members and assemblies thereof, used in various fabrication purposes. With more particularity, this invention relates to structural members preferably (but not exclusively) formed from plastic or composite materials, and a support mat assembly fabricated therefrom.

2. Related Art

Structural members of many different varieties are old in the art. In particular, so-called "I-beams," bearing that name because the cross-sectional shape of the structural member resembles the letter "I," have been used for many, many years in building fabrication and the like. Such I-beams were primarily made of iron or steel. The typical I-beam, well known in the art, has two spaced-apart parallel flanges connected by a central web. A key advantage to use of an I-beam, as opposed to a solid beam having the same outer dimensions, is that the I-beam is much more structurally "efficient." By that is meant that a tremendously reduced volume and weight of material is needed to yield a structural member having nearly the same rigidity as a solid beam. This is because the greatest rigidity is contributed by material at the most distant points from the bending axis of the beam. In a solid beam, the large volume of material relatively close to the bending axis contributes relatively little to rigidity.

In addition, due to their geometry, I-beams have high vertical or compressive load capacity (that is, loads perpendicular to the face of the flange). Thereby, I-beam structural members are suitable and desirable for support surfaces.

A drawback to I-beams is relatively low torsional (twisting) rigidity. This results, in part, from the absence of the material adjacent the central web.

These properties of I-beam structural members make them suitable for building transit and support areas for heavy equipment, especially on relatively soft terrain. Such transit and support areas are frequently needed in, for example, construction, military, and oilfield applications. However, it is not feasible to use iron or steel I-beams for such applications, as they would be far too heavy and too expensive, and further are subject to corrosion. While it may be possible to form I-beams out of lighter and less expensive materials such as wood, decay is a problem, since the application is often in a wet, soft terrain environment. Wooden members therefore often turn out to be single-use members due to rotting, breaking and splintering from high loads, etc.

It is desirable to form mat assemblies suitable for use in soft terrain, which combine the favorable attributes of relatively low cost, low weight, high load bearing capacity, and resistance to decay. The present invention combines certain favorable aspects of I-beams (high rigidity, high load bearing capability), while maintaining vertical load capacity and increasing torsional rigidity through the addition of filler blocks, and with highly decay-resistant materials (plastic or composite materials, or light weight metals such as aluminum), to form very strong mat assemblies having a reasonable cost.

SUMMARY OF THE INVENTION

The present invention is a generally I-beam shaped structural member having spaced apart flanges connected by a central web, and a mat assembly formed from such I-beams. The edges of the I-beam flanges are formed into repeating geometric profiles, such as tongue and groove profiles, which mesh with the tongues and grooves of adjacent I-beams when butted together. A preferred embodiment of the I-beam of the present invention is a "double" I-beam, that is, resembling two I-beams stacked one atop the other, thereby yielding three flanges connected by a central web. Preferably, the I-beam is fabricated via extruding plastic or composite materials. A mat assembly, according to a preferred embodiment of the present invention, is comprised of a plurality of I-beams, disposed adjacent one another and butted together so that the flange edge tongues and grooves mesh together. Filler blocks are disposed in at least some of the cavities between the webs of adjacent I-beams, and provide increased strength and torsional rigidity. The filler blocks also prevent distortion or bending of the central webs, thereby preserving the load bearing capacity of the I-beams, and serve to seal the cavities between the webs, to prevent liquids and solids from entering the cavities. A means for connecting the I-beams is provided, which in the preferred embodiment is a tension member, such as a rod, cable, chain, or other means. The tension member extends through the webs and the filler blocks, and holds the I-beams and filler blocks together to form the mat assembly. Adhesives and/or welding may optionally be used to join the I-beams.

DESCRIPTION OF SOME PRESENTLY PREFERRED EMBODIMENTS

While the present invention lends itself to various embodiments, as will be recognized by those having ordinary skill in this art field, with reference to the drawings some presently preferred embodiments will be described.

Figure 1A:
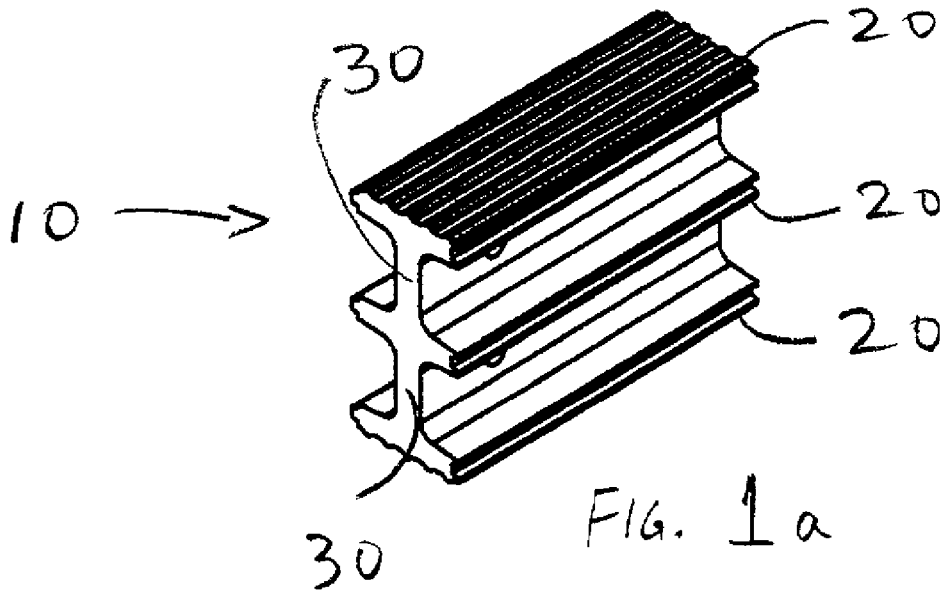
FIGS. 1*a* and 1*b* are perspective and cross section views of one embodiment of the I-beam support member of the present invention.
Figure 1B:
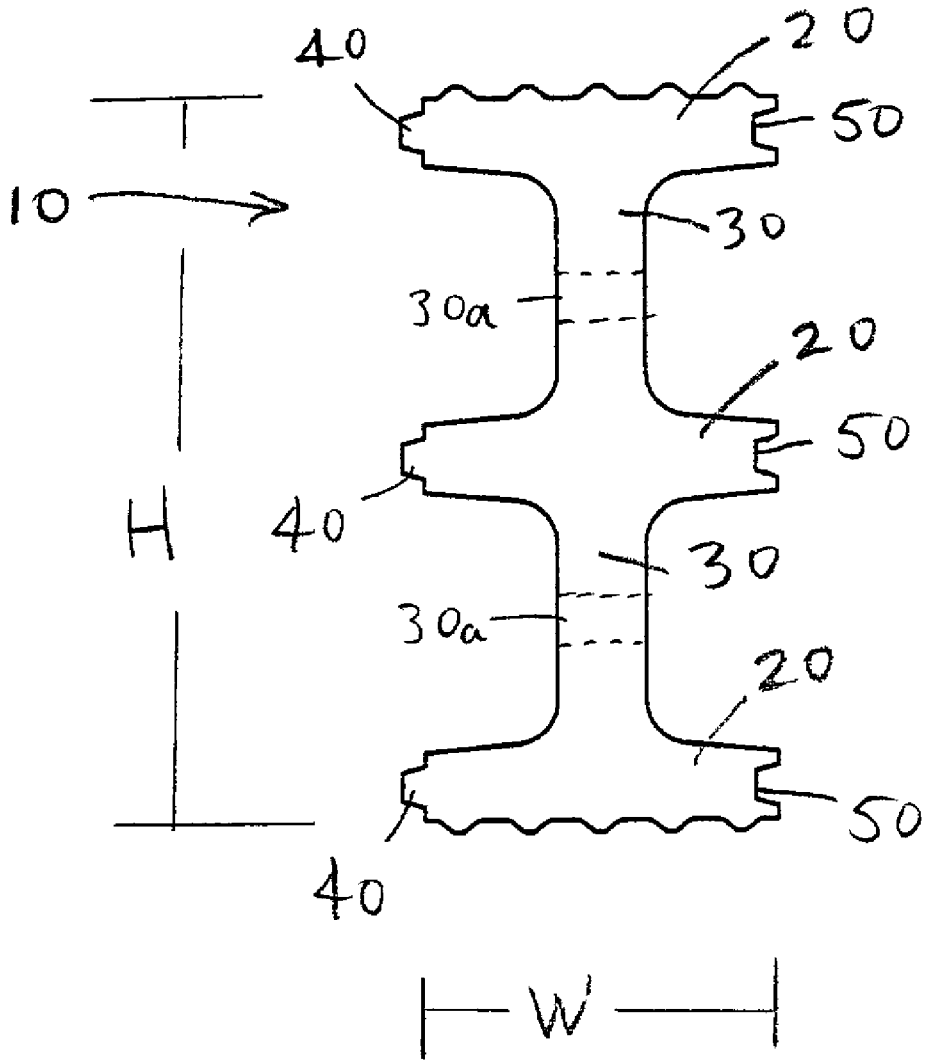
Figure 2A:
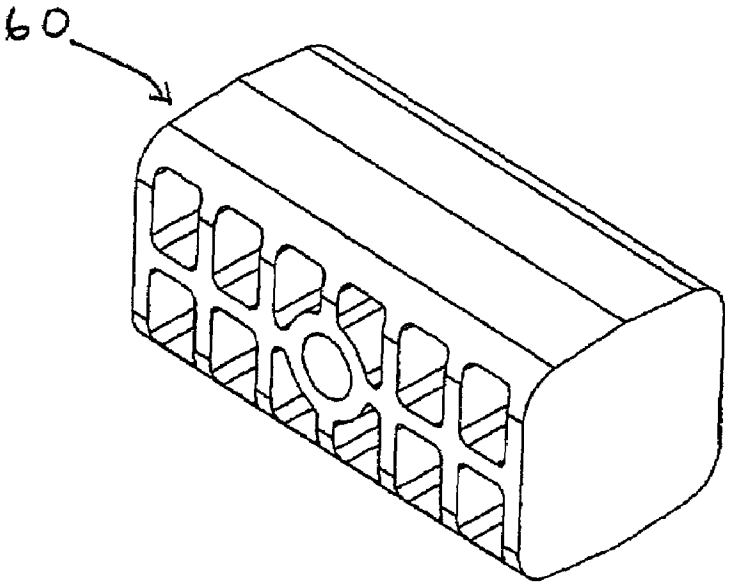
FIGS. 2*a*-2*d* are perspective and section views of one embodiment of the filler block.
Figure 2B:
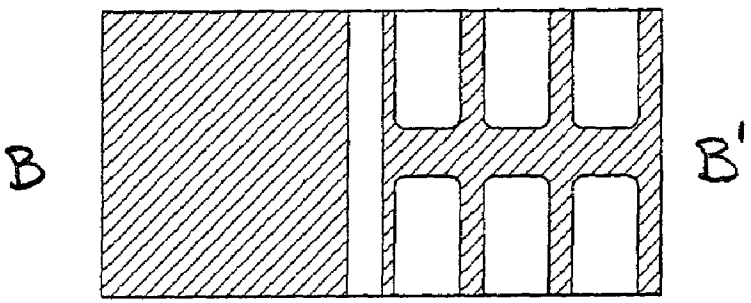
Figure 2D:
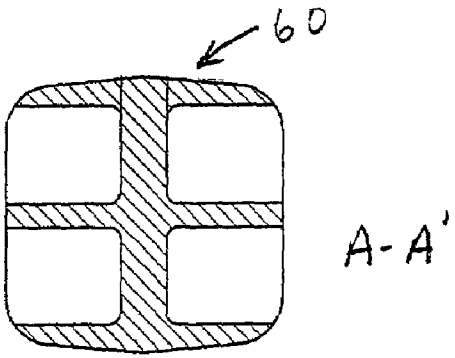
Figure 2C:
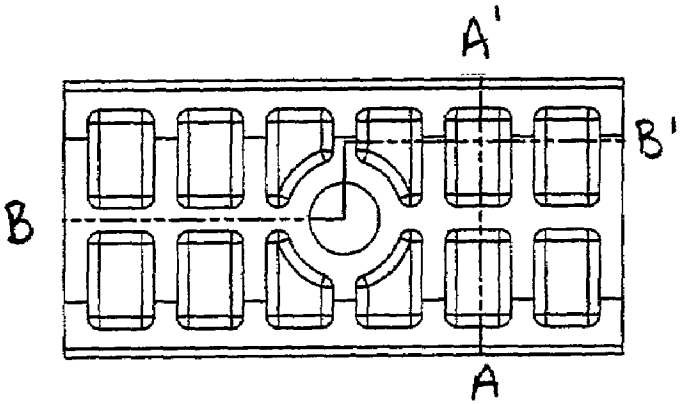

FIGS. 1*a* and 1*b* are perspective and cross section views of one embodiment of the I-beam structural member of the present invention. In this embodiment, beam 10 comprises three spaced apart flanges 20 connected by webs 30. In effect, a "double I-beam" is formed. Each edge of flanges 20 comprise a recurring geometric profile adapted to mesh together with an adjacent I-beam, and in the preferred embodiment is either a tongue 40 or groove 50 profile. Preferably, each flange 20 has a tongue 40 on one edge and a groove 50 on its other edge. Further, each flange on a single beam has its tongue and groove on the same side as the tongues and grooves of the other flanges on the same beam. Said another way, all tongues 40 are on the same side of beam 10, and all grooves 50 are on the same side of beam 10. This facilitates the meshing together of beams 10, one to the next to form the mat assembly of this invention, as later described.

Preferably, beam 10 is formed from a composite or plastic material. Preferred materials for fabrication of the beam are various plastics, composite materials, fiber-reinforced composites, etc., including (by way of example only) filled and unfilled polyethylene, poly propylene, and polyvinyl chloride (PVC). Fillers which may be used in the present invention include fiberglass, minerals, organic materials, silk, bagasse, and other natural and synthetic fibers. Resins known in the art and suitable for the beam may have tensile strengths of 12,000 to 20,000 psi. Beam 10 is preferably formed via extrusion, although it is understood that other forming means known in the art could be used, including but not limited to pour molding, injection molding, compression molding and the like. Other suitable materials for beam 10 are lightweight metals, such as aluminum and aluminum alloys.

Beam 10 may be made in many different dimensions to suit particular applications. However, one exemplary embodiment suitable for many applications has a height H of approximately 8 inches, width W of approximately 4 inches, and a thickness of the flanges and web of approximately 1 inch. When in these approximate cross-section dimensions, most materials yield a beam weighing approximately 7 lb./linear foot. Beam 10 may be made in various lengths, by way of example up to 30 to 40 feet long; however, longer or shorter lengths may be made as desired, for easy handling in assembly and of the assembled mats, as described later. However, it is understood that the scope of the invention is not limited to any particular dimension or combination of dimensions.

Figure 3:
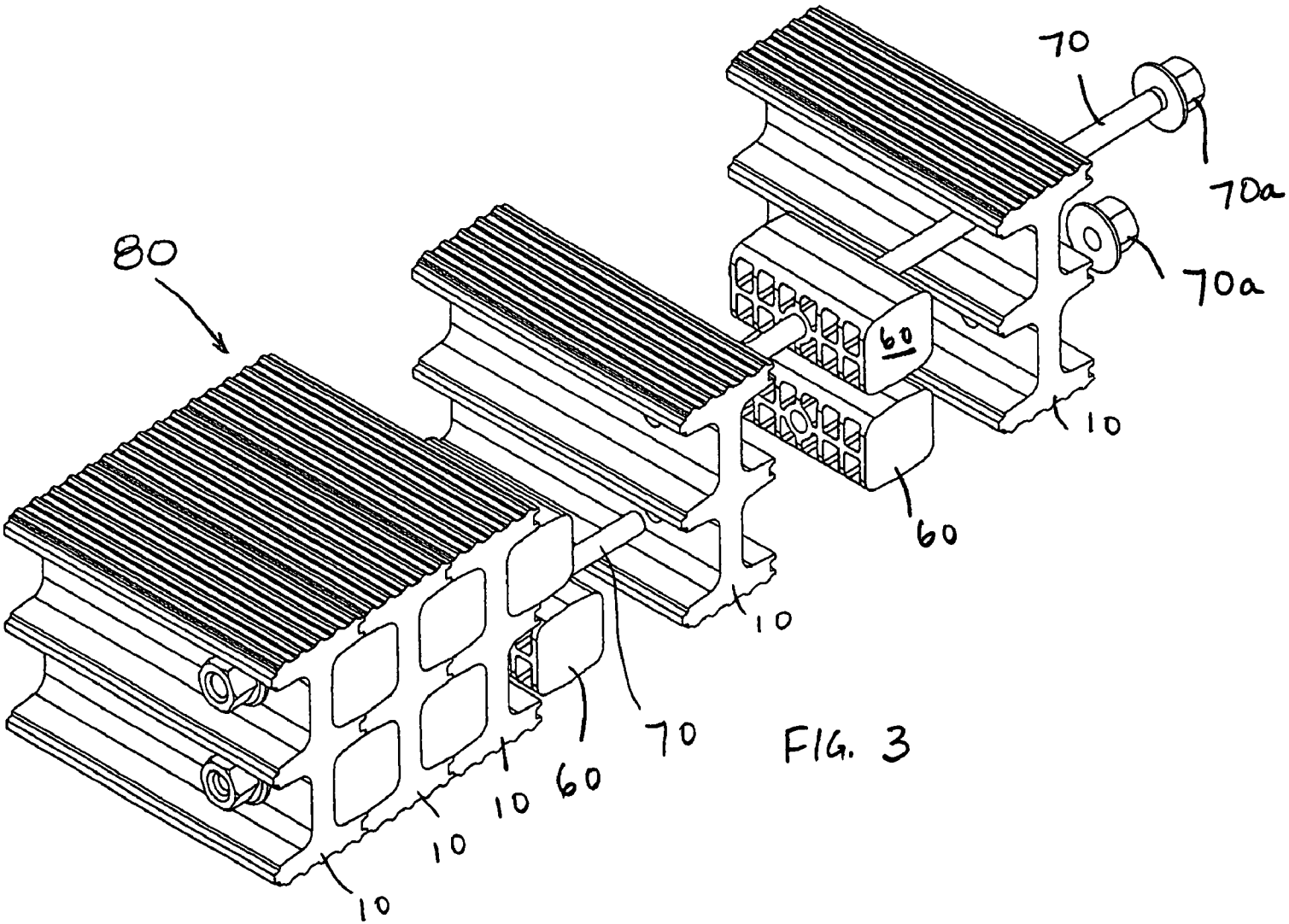
FIG. 3 is a perspective view of a mat assembly, partially exploded, with certain element numbers omitted for clarity.
Figure 4:
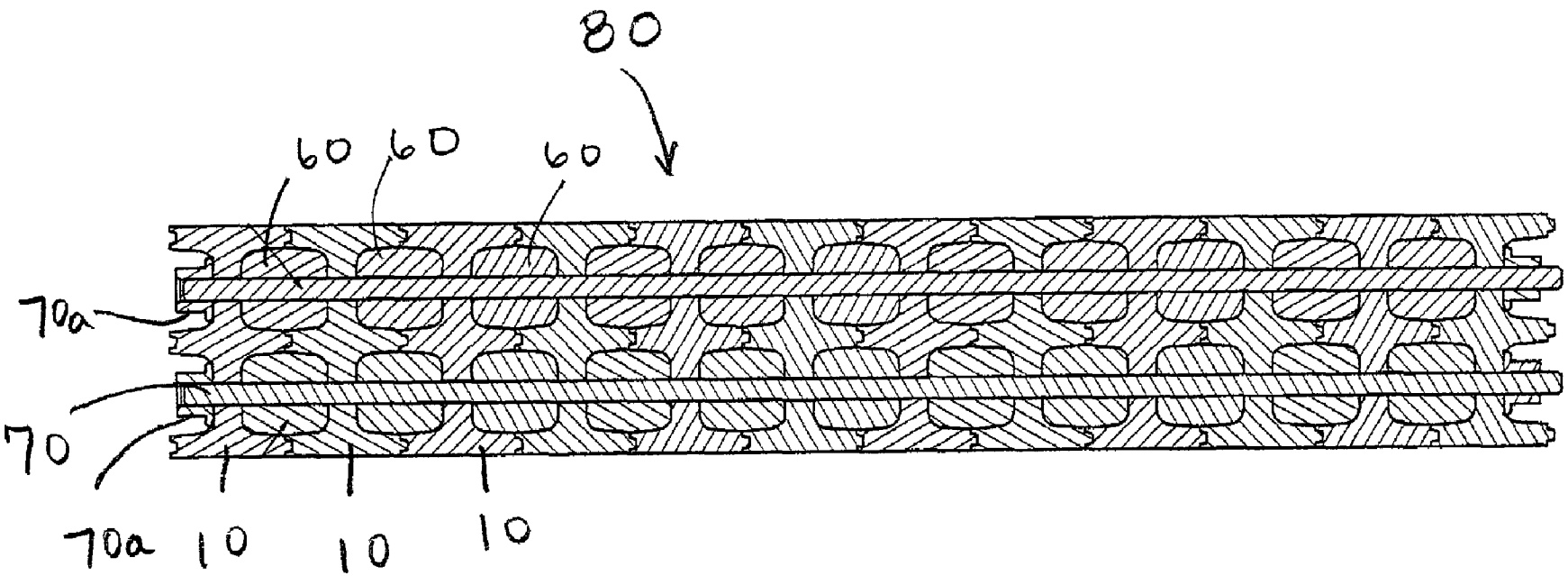
FIG. 4 is a cross section view of a mat assembly.

As will be later described in more detail, the mat assembly of the present invention also comprises filler blocks 60, shown in FIGS. 2*a*-2*d*, which fill a portion of the cavities between webs of adjacent beams 10, as shown in FIGS. 3 and 4. Filler blocks 60 are elongated blocks having cross-sectional shapes and dimensions adapted to largely fill the cavities created between webs of adjacent beams 10. Approximate resulting dimensions are rounded rectangle approximately 3" high, 3" wide in cross section, and approximately 6" long. The embodiment of filler blocks 60 shown fill only a portion of the beam cavity, adjacent to the tension member penetration (described later); however, it is understood that if desired the entirety of the web cavity could be filled. Preferred materials for filler blocks 60 are various plastic and composite materials, and may be formed from the same materials which beams 10 are formed. Yet another possible material for filler blocks 60 is urethane. In order to minimize the quantity of material used, and thus cost, filler blocks 60 preferably have a catacomb interior structure, as seen in FIGS. 2*a*-2*d*.

FIG. 3 shows one embodiment of the mat assembly of the present invention. A plurality of beams 10 are arranged adjacent one another, and butted together, so that mating tongue 40 and groove 50 profiles of adjacent beams 10 mesh together. Filler blocks 60 are disposed in the cavities between the webs of adjacent beams 10. Webs 30 and filler blocks 60 comprise holes 30*a* and 60*a*, which are aligned with each other in the assembled mat. To assemble and hold together a desired number of beams 10 and filler blocks 60, a means for connecting the I-beams together is used. In one presently preferred embodiment, the means for connecting comprises tension member 70 run through beams 10 and filler blocks 60 (via holes 30*a* and 60*a*). End fasteners 70*a* are attached to apply tension to tension members 70, and thereby force the plurality of beams 10 tightly together to form mat assembly 80. In the presently preferred embodiment, tension member 70 comprises a steel "all thread" rod, with nuts serving as end fasteners 70*a*. The nuts are simply made up on the all thread rods by wrenches, etc. as customary in the art, to force beams 10 together. Alternative embodiments of tension member 70 could be ropes of various materials, chain, plastic or composite rods, etc. It is further understood that the means for connecting beams 10 to form mat assembly 80 may also comprise adhesives or welding (whether plastic welding or metal welding). The adhesives or welding to join I-beams 10 may be in addition to tension member 70, or in lieu thereof.

The sequence of beam 10 and filler block 60 assembly can be varied. One presently preferred method is to essentially "stack" the I-beams 10 and filler blocks 60 (if used) onto tension members 70, until the desired number of beams 10 are butted together, then end fasteners 70*a* installed and suitable tension applied. Other desired sequences of assembly can of course be used.

It is understood that other embodiments of mat assembly 80 omit filler blocks 60.

The resulting mat assembly 80 exhibits high rigidity and support strength. The tongue and groove profiles in the beam flanges transfer loads from one beam to the next, and prevent slipping of one beam relative to the next. Mat assembly 80 may be pre-assembled before being brought to the work site, and transported via truck and placed in position with fork lifts, cranes, etc. Alternatively, beams 10, filler blocks 60, and tension members 70 may be brought to the work site, and mat assembly 80 assembled on the spot.

The materials and structural shape of mat assembly 80 results in a relatively light weight mat, in view of its load bearing capacity. By way of example, a mat assembly of dimensions of 4'×24' weighs approximately 2000 pounds.

As seen in the figures, especially 1*a*, 1*b*, and 3, the outer surfaces of flanges 20 are preferably formed with a traction surface, for example grooves 90. Grooves 90 may be readily formed during the extrusion (or other forming) process. In the assembled mats, grooves 90 run transverse to the normal direction of travel of (for example) wheeled vehicles traversing the mat, and grooves 90 thereby provide greatly increased traction. It is understood that other designs for traction surfaces, such as a diamond shape cross hatching or the like, can be formed, either during the manufacturing of beam 10 or subsequently by machining, etc. Additional surface treatments may be applied for skid resistance and traction, such as overlays which may be adhesively bonded to the flange surfaces, or "roll on" patterns.

While mat assembly 80 lends itself to many different applications, one advantageous use of the present invention is in the support of heavy equipment, vehicles and machinery over soft terrain. Roadways or pads can be formed from the mat assemblies, which are capable of handling extremely high loads from wheeled or tracked vehicles such as draglines, etc., stationary equipment and the like. Possible uses include military applications, as well as industrial applications. Oilfield related use may be in the applications traditionally filled by wooden "board roads." Yet another possible use is as decking to cover open spans. An advantage of the present invention is not only the high load capability, but also the resistance to decay, making repeated and long term use even in wet environments quite practical.

Figure 5C:
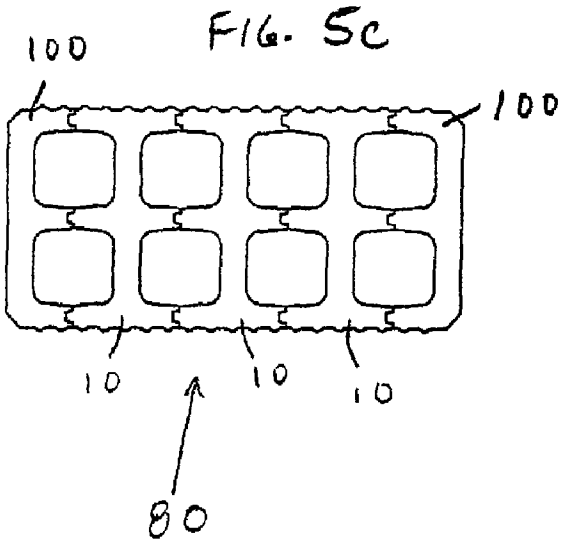
FIGS. 5*a*-5*c* show another embodiment of the invention, comprising end caps.
Figure 5B:
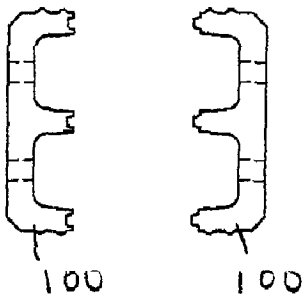
Figure 5A:
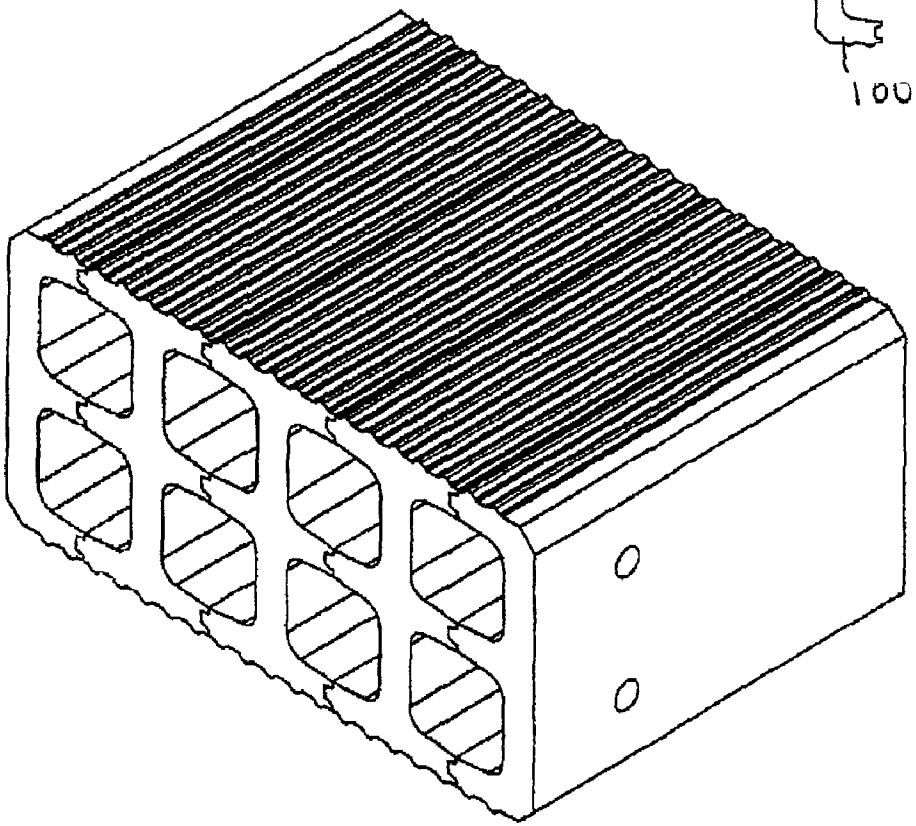
Figure 6:
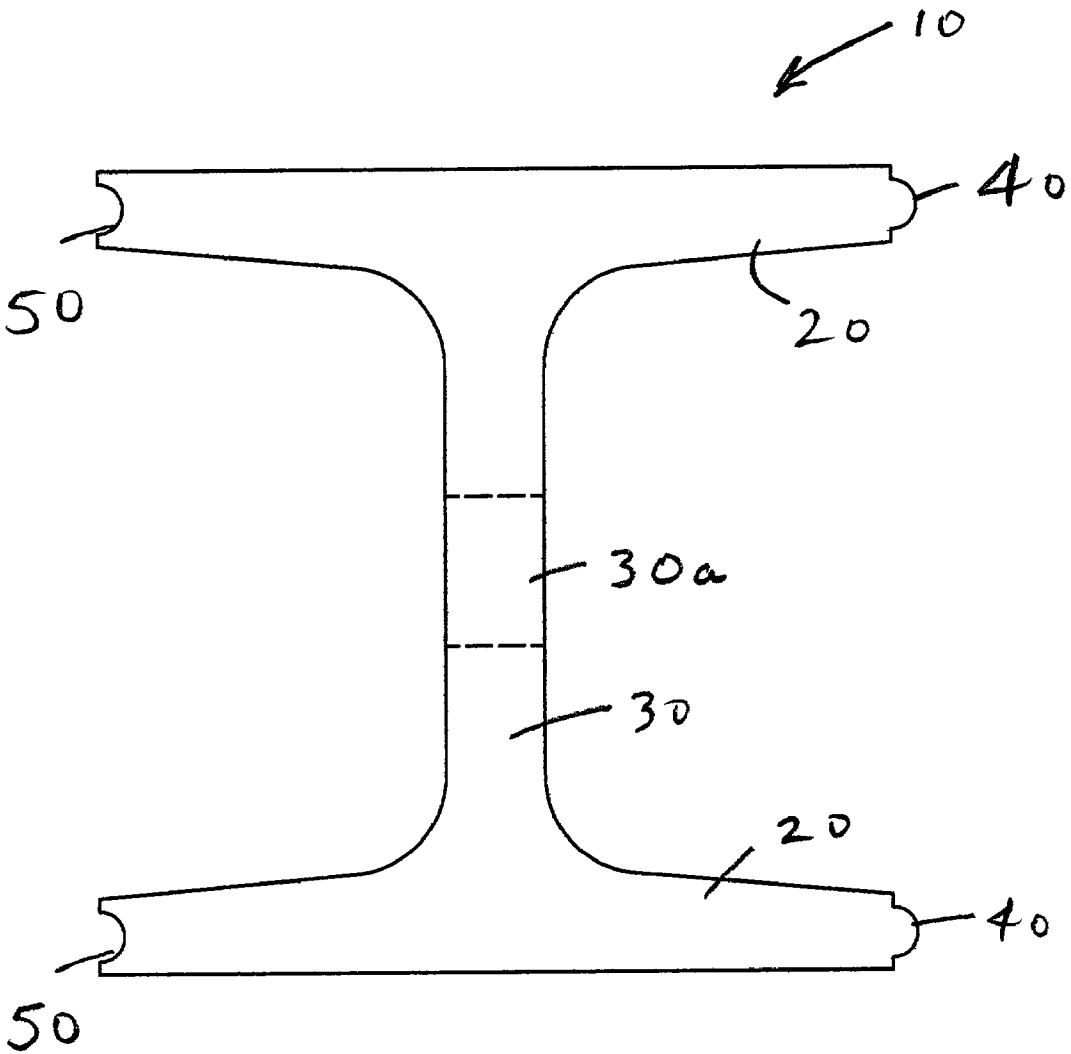
FIG. 6 is a cross section view of another embodiment of the I-beam.
Figure 7A:
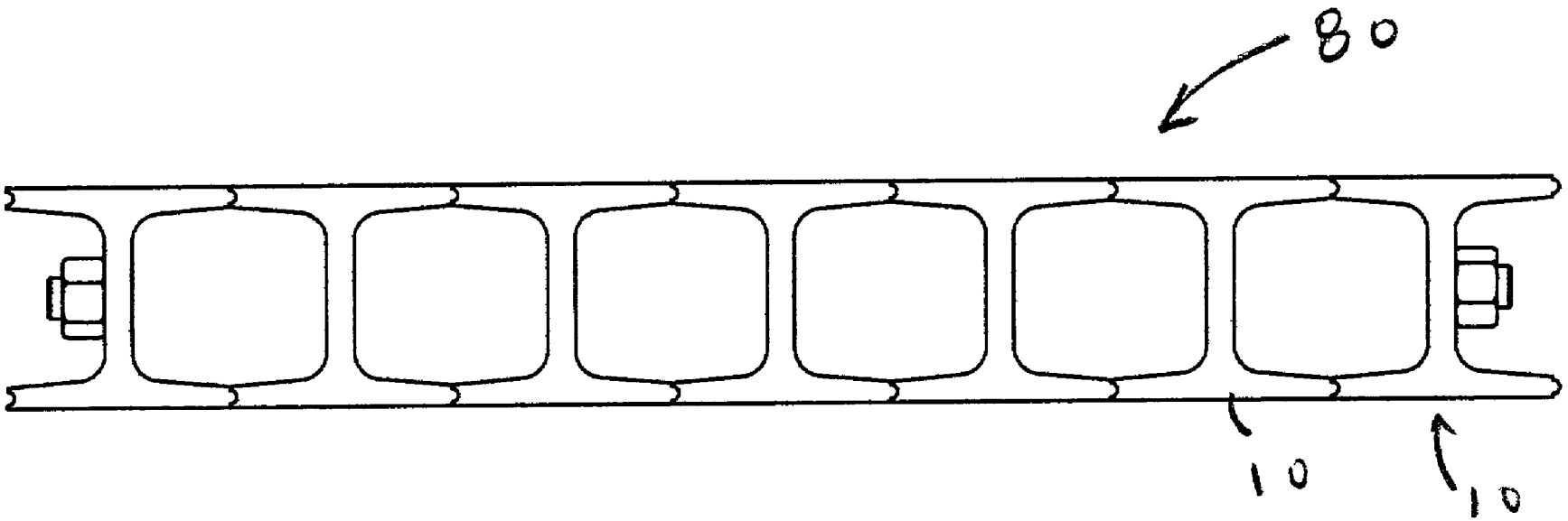
FIGS. 7*a*-7*c* are perspective and cross section views of a mat assembly formed with the I-beam shown in FIG. 6.
Figure 7B:
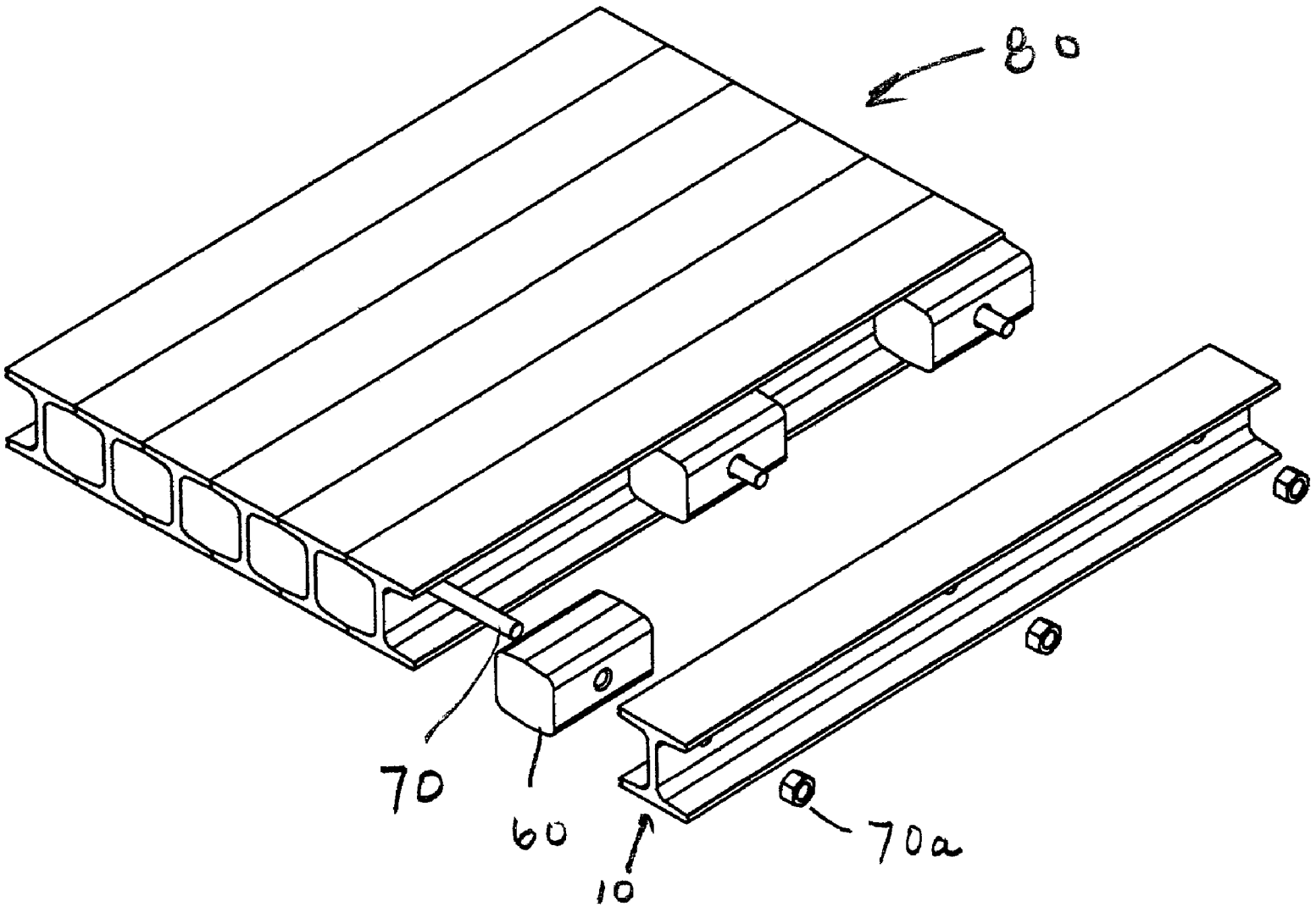
Figure 7C:
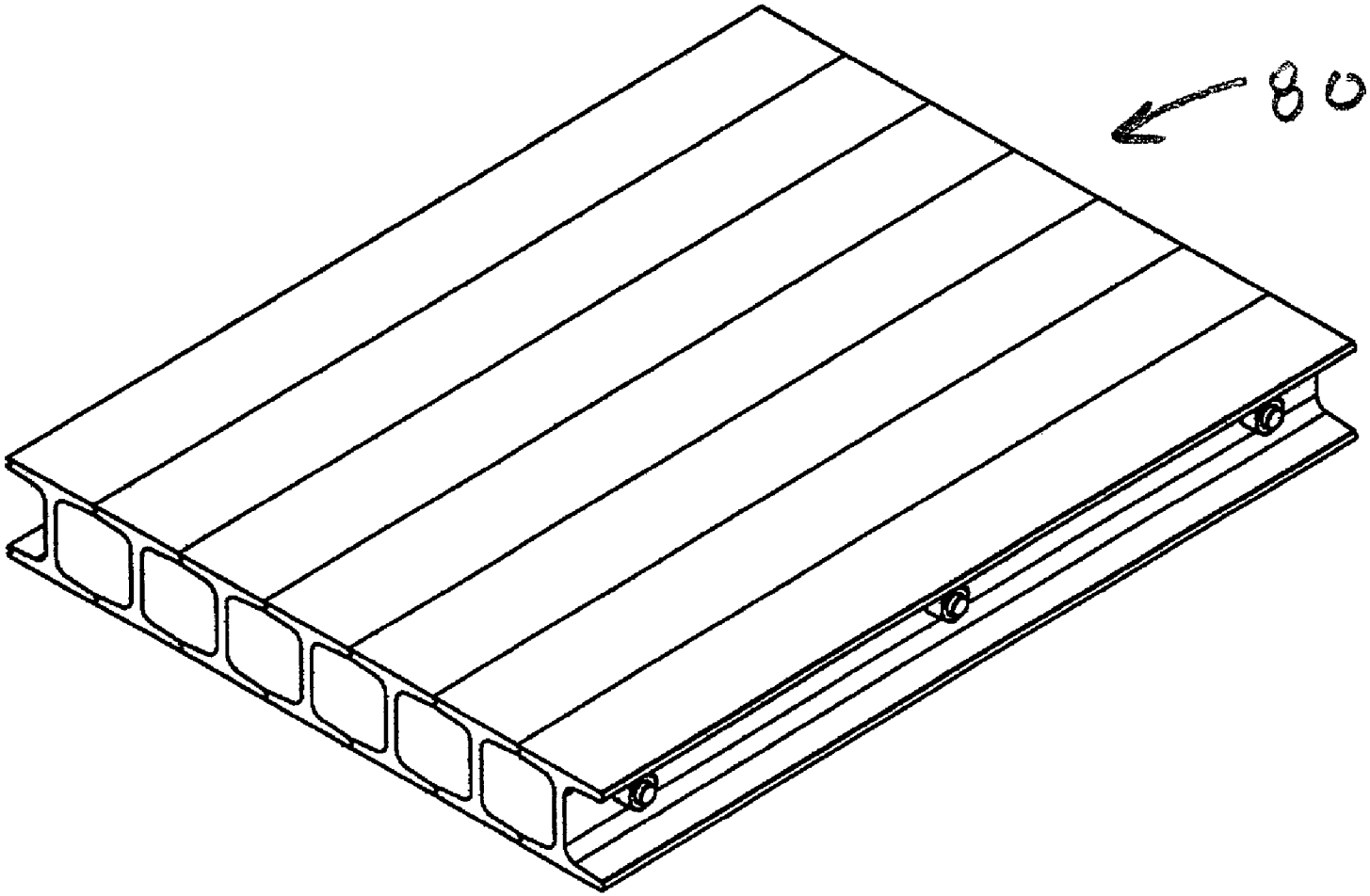

Other embodiments of the invention are possible. For example, FIGS. 5*a*-5*c* show an embodiment of mat assembly 80 comprising end caps 100, which cover the outermost ends (beam cavities) of beams 10 in an assembled mat. End caps 100 prevent dirt, mud, etc. from filling the outermost cavity, and protect end fasteners 70*a* which would otherwise be exposed. End caps 100 comprise tongue and/or groove profiles to mate with the grooves and/or tongues of the beams to which they mount. End caps 100 may be fastened to the mat assembly via adhesive or welding, or tension member 70 can penetrate end cap 100, then fastener 70*a* and a gasket attached to ensure a seal.

Yet another embodiment is shown in FIGS. 6*a* and 6*b*, and 7*a*-7*c*. This embodiment comprises a "single I-beam" shape, instead of the "double I-beam" shape of the previously described embodiment. It is understood that the scope of the invention comprises any number of I-beam configurations, e.g. "triple I-beams," "quadruple I-beams," etc.

Figure 8A:
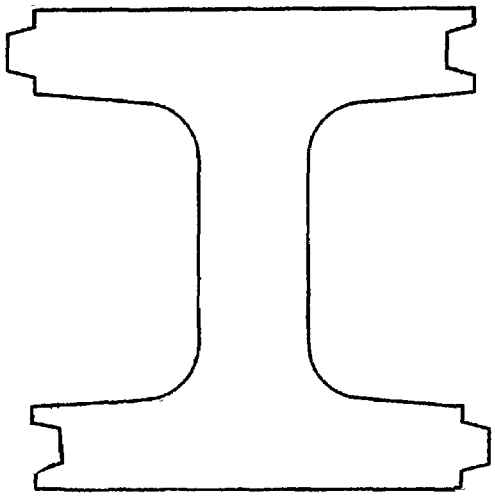
FIGS. 8*a*-8*c* show alternative embodiments of the I-beam.
Figure 8B:
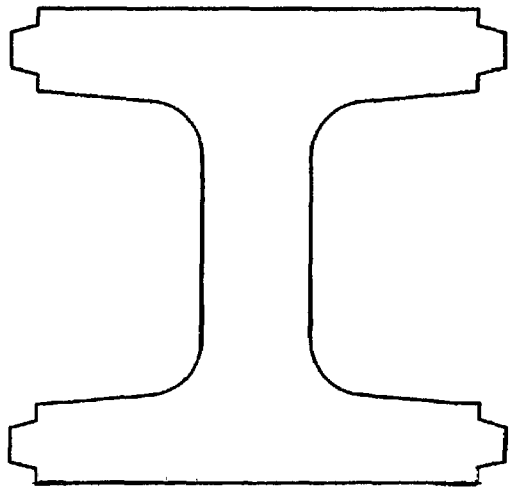
Figure 8C:
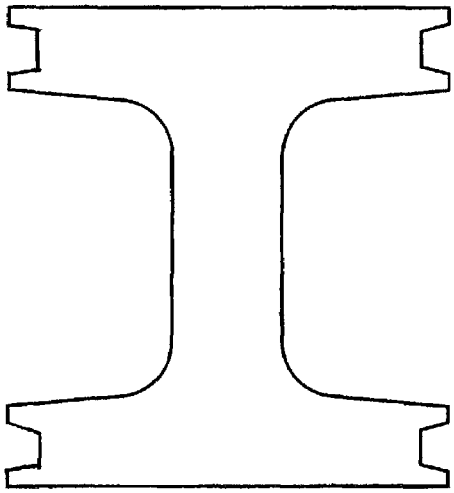
Figure 9:
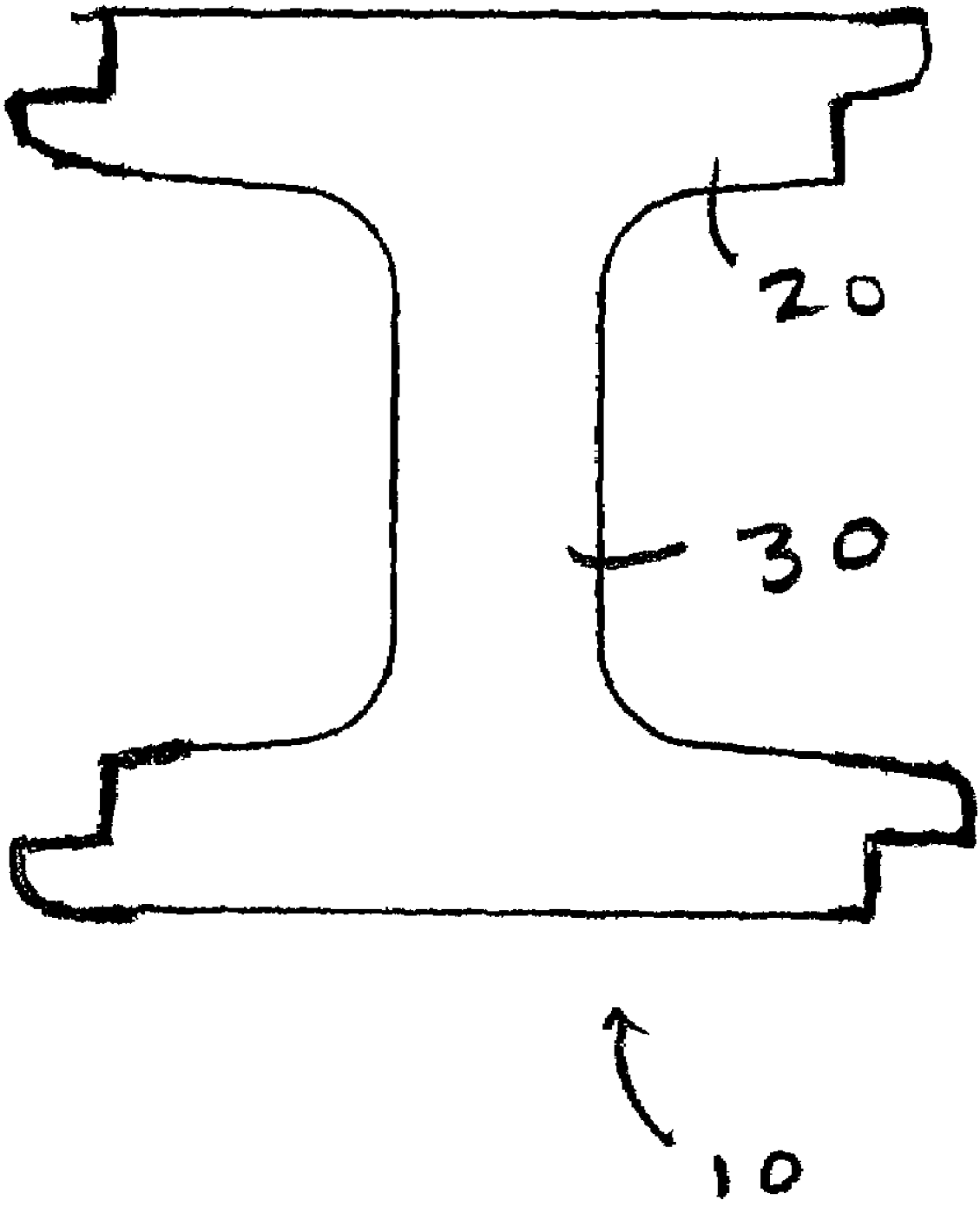
FIG. 9 shows another embodiment of the I-beam.

While the preceding description contains many details of the invention, it is understood that they are offered to illustrate some of the presently preferred embodiments and not by way of limitation. Numerous changes are possible, while still falling within the scope of the invention. For example, the beams and filler blocks may be formed by different methods and of different materials. Injection, extrusion, pour, plug, and compression molding are all possible molding methods. A wide variety of plastics, composite, fiber-reinforced composites, resins, etc. may be used. Dimensions and shapes may be altered to suit particular applications. Triple, quadruple, etc. I-beam shapes could be used, with various numbers of flanges sharing a common central web. Yet another embodiment is I-beams having flanges as disclosed, wherein a single I-beam has all tongue or all groove profiles on the flange edges. Such an I-beam, for example having all tongue profiles, would mate with another I-beam having all groove profiles on the flange edges. For example, FIGS. 8*a*-8*c* show additional embodiments of the I-beam profiles, within the scope of the invention. More generally, any recurring flange edge geometry or flange edge treatment, for example that shown in FIG. 9, which permits meshing or unification of the beams into a mat assembly, could be used and is within the scope of the present invention. The I-beams, and mats, could be of light weight metals such as aluminum.

Therefore, the scope of the invention should be limited not by the foregoing description, but by the scope of the appended claims and their legal equivalents.

I claim:

1. A support mat assembly comprising:

a) a plurality of structural members, each comprising I-beams having at least three spaced apart parallel flanges connected by a web, when viewed in a plane perpendicular to a longitudinal axis of said I-beam, each of said flanges having outwardly facing outer edges at a point distal from said web, each of said outwardly facing outer edges comprising tongues and grooves which mesh together with corresponding tongues and grooves in the outwardly facing outer edges of the flanges of an adjacent I-beam and prevent relative vertical movement between adjacent I-beams, said plurality of I-beams disposed adjacent one another so that said tongues and grooves of said outwardly facing outer flange edges of adjacent I-beams mesh together, thereby forming cavities between said webs of said adjacent I-beams; and b) a means for connecting said I-beams together comprising a tension member disposed through holes in said webs, and fasteners on either end of said tension members.

2. The mat assembly of claim 1, further comprising filler blocks disposed in at least some of the cavities created between said webs of said adjacent I-beams, and wherein said tension member is further disposed through holes in said filler blocks.

* * * * *